United States Patent [19]

Gelfand

[11] 4,043,893

[45] Aug. 23, 1977

[54] ELECTRICAL CONTACT

[75] Inventor: Leonard Gelfand, Orange Village, Ohio

[73] Assignee: Erico Products, Inc., Cleveland, Ohio

[21] Appl. No.: 672,054

[22] Filed: Mar. 31, 1976

[51] Int. Cl.[2] ..... C25B 9/04

[52] U.S. Cl. ..... 204/281; 204/286; 204/288; 174/94 R; 339/275 R; 339/278 C

[58] Field of Search ..... 204/281, 288, 289, 279, 204/280, 286; 174/94 R; 339/275 R, 278 C

[56] References Cited

U.S. PATENT DOCUMENTS

| | | | |
|---|---|---|---|
| 2,743,227 | 4/1956 | Waite et al. | 204/288 |
| 2,999,800 | 9/1961 | Reeside | 204/196 |
| 3,001,924 | 9/1961 | Battis et al. | 204/197 |
| 3,424,668 | 1/1969 | Fischer | 204/281 |

FOREIGN PATENT DOCUMENTS

| | | | |
|---|---|---|---|
| 314,811 | 10/1969 | U.S.S.R. | 204/281 |

*Primary Examiner*—T. Tung

*Attorney, Agent, or Firm*—Donnelly, Maky, Renner & Otto

[57] ABSTRACT

An improved aluminum electrode hanger contact and method of making the same, which includes a longitudinal hole drilled in the end of the hanger. In one embodiment, a slot or slots are cut in such bar into the hole. Tin-coated copper inserts are inserted in the slot or slots with the inner ends thereof projecting into the hole and the outer ends closely underlying or projecting from the end of the hanger. In other embodiments, circular passages are provided transversely of the drilled hole and inserts in the form of tin-coated copper rod or rods are inserted in the passages. Superheated molten metal is permitted to flow into the hole filling the same, such molten metal preferably being obtained by the ignition of an aluminothermic welding composition. When the molten metal solidifies, the inserts are secured to the hanger, thus providing a low cost and significantly improved voltage drop contact between the aluminum hanger and a conductor.

23 Claims, 24 Drawing Figures

ELECTRICAL CONTACT

This invention relates generally as indicated to an electrical contact and method for making the same and more particularly to an improved aluminum electrode hanger contact, such hanger being adapted to be supported at the sides of a tank with the electrode supported thereby in the tank.

In electrolytic processes such as electroplating or electrowinning, the electrodes are supported on the side edges of an elongated tank by a hanger bar which, on one side of the tank, contacts a usually notched copper conductor bar, while the other end of the hanger bar is supported on a wooden rail or other type insulator on the opposite side of the tank. In certain electrolytic processes, such as the electrowinning of zinc, the cathodes of one tank may be electrically connected to the anodes of an adjacent tank by wedge shape copper contacts on the ends of the anode bars with the electrical contact end of the cathode hanger being supported between adjacent anodes.

The hanger of the present invention may, however, support a cathode, an anode, or such electrode in the form of a starting sheet. Because of the cost of copper, aluminum has largely replaced copper in the construction of hangers. However, because of electrical corrosion and oxidation problems, good electrical contact between the aluminum hanger and the copper conductor bar or anode is difficult to obtain and maintain.

In the past, copper contacts on the ends of the hanger bars have, for example, been formed by rectangular copper sleeves which may be extruded or rolled, carefully fitted on milled extensions of the bar and welded in place. Also, U-shaped clips have been secured to the bottom of the bar by Heliarc, M.I.G. or T.I.G. welding. Any contact involving a rectangular extruded or rolled sleeve and a milled projection on the bar is difficult to fabricate and even more difficult to replace when the contact becomes worn or corroded. In normal welding techniques, such as those mentioned above, brittle welds are oftentimes obtained which may cause the contact clip to become dislodged. Again, such contacts are difficult to replace. Finally, such contacts after continued use usually provide an unsatisifactory electrical contact with a too large voltage drop.

With the present invention, the end of the hanger is provided with a drilled hole and, in one form, a slot or slots communicates with the hole to provide a keyhole slot or slots in the end of the bar. Stamped, tin-coated copper sheets are then placed longitudinally in the keyhole slot or slots. In another form, tin-coated copper rod formed to the desired configuration is inserted through transverse circular passages into the drilled hole. Such clips or rods are then secured in place by casting superheated metal into the drilled hole. The metal is preferably cast by an aluminothermic process.

It is accordingly a principal object of the present invention to provide an inexpensive copper contact for an aluminum conductor.

Another principal object is the provision of an inexpensive contact for an aluminum hanger in electrolytic processes.

A further principal object is the provision of an improved, less expensive contact for an aluminum electrode hanger providing better conductivity.

Yet another important object is the provision of an improved contact for an aluminum electrode hanger which can easily be replaced when required.

Still another object is the provision of an improved electrical contact for an aluminum electrode hanger which is obtained by providing the end of the bar with a drilled hole, inserting a copper insert into the hole, and securing the same in place by superheated cast metal filling the hole.

Yet another object is the provision of an improved method of making such contact which can be employed again and again on the same bar as the contact becomes worn or corroded.

It is also an object of the invention to provide a copper contact for an aluminum conductor which can easily be fabricated and then electrically and mechanically secured by an aluminothermic process.

Another object is the provision of an improved contact for a cathode hanger which may be tailored to the type of conductive support employed.

Other objects and advantages of the present invention will become apparent as the following description proceeds.

To the accomplishment of the foregoing and related ends, the invention then comprises the features hereinafter fully described and particularly pointed out in the claims, the following description and the annexed drawing setting forth in detail certain illustrative embodiments of the invention these being indicative, however, of but a few of the various ways in which the principles of the invention may be employed.

Figure 1:
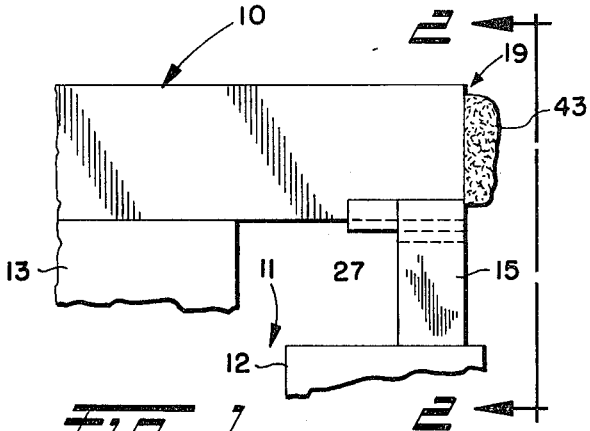
FIG. 1 is a fragmentary, broken away, side elevation of an electrode hanger in accordance with one preferred form of the present invention supported at one end on a conductor bar.
Figure 2:
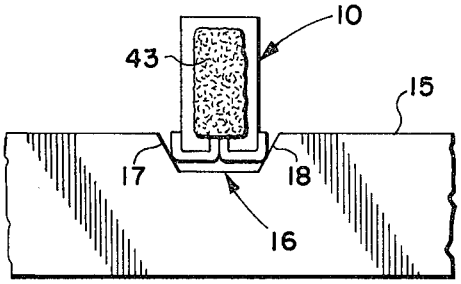
FIG. 2 is an end elevation of the hanger as seen from the line 2—2 of FIG. 1.

Referring first to FIGS. 1 and 2, there is illustrated one form of a hanger bar 10 in accordance with the present invention which extends across the top opening 11 of tank 12 and supports, suspended into the tank, an electrode or starter sheet 13. The hanger bar is supported across the top of the tank on a conductor bar 15 at one side edge of the tank and on a wooden rail or insulator bar at the opposite edge of the tank, not shown.

The conductor bar is provided with longitudinally spaced notches in the top edge thereof, one of which is indicated at 16, such notches usually having a flat bottom as indicated with oppositely, outwardly inclined side edges seen at 17 and 18. The contact end 19 of the bar 10 is thus suppported in the notch 16, and the present invention deals with the formation, preparation, and construction of the contact end of the bar to ensure a low-cost, easily replaceable good electrical contact between the hanger bar and the conductor bar.

Figure 4:
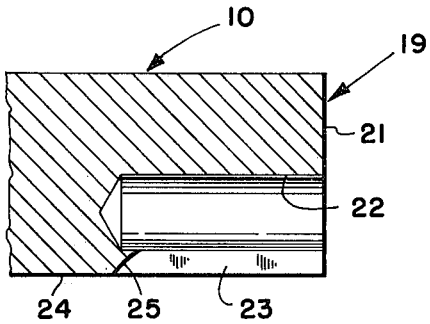
FIG. 4 is a fragmentary vertical section of the contact end of the hanger bar taken substantially from the line 4—4 of FIG. 3.
Figure 3:
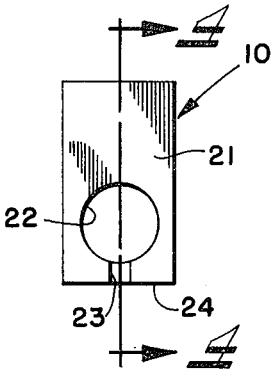
FIG. 3 is an end elevation, slightly enlarged, of the hanger bar showing the end preparation with the keyhole slot placed therein.

Referring now to FIGS. 3 and 4, there is illustrated the preparation required for the hanger bar end 19. The first step in end preparation is to drill a hole in the end face 21 of the bar extending longitudinally of the bar as indicated at 22. The next step is to cut a slot in the bottom of the bar as indicated at 23 so that such slot extends from the bottom 24 of the bar into the drilled hole 22. If a circular saw is employed to cut out the slot 23, the end of the slot will have the radius 25 due to the radius of the saw. Such slot may be cut, for example, with a small woodworking table saw, but it is preferable to use as small a diameter blade as practical. In drilling the hole 22 in the aluminum bar, it is important that no lubricant be used since a further cleaning operation might then be required. Further, a lubricant could cause welding problems if it is an evaporative type fluid which would leave an oil or wax residue. Also, the end face 21 of the bar must be flat if the aluminothermic process, described hereinafter, is employed since the mold used in such process seals on the surface 21. No other machining of the bar end sould be required.

After the completion of the bar end preparation, a pair of J-shape, copper inserts 27 and 28 are inserted into the slot in back-to-back fashion. Since such inserts are identical in form, only one of such inserts will be described in detail.

Figure 5:
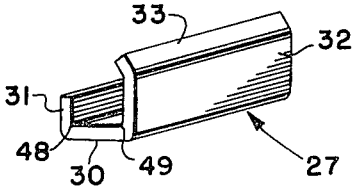
FIG. 5 is an isometric view of one of the copper inserts employed with such embodiment of the present invention.

Referring now to FIG. 5, the insert 27 comprises a bottom portion 30, an outer upturned flange 31, and an inner upturned stem 32, which is bent slightly outwardly at the top edge thereof as indicated at 33. The insert is formed by stamping copper strip, and in the stamping operation, it is desirable to bend the radii to be as small as possible to eliminate, as much as possible, fit problems. The bent upper edge 33 of the stem 32 is preferred to give added mechanical interlocking when metal is cast in the hole and also provides additional surface for sweating to the copper to provide improved electrical properties.

Before inserting the inserts into the hole and slot in back-to-back fashion as indicated, such inserts are tin coated, either by a hot dip or electrotinning process, in either case using pure tin. After such tinning of the inserts, the inserts are inserted into the hole and slot until the ends of the inserts are flush with the end face 21 of the bar.

Figure 11:
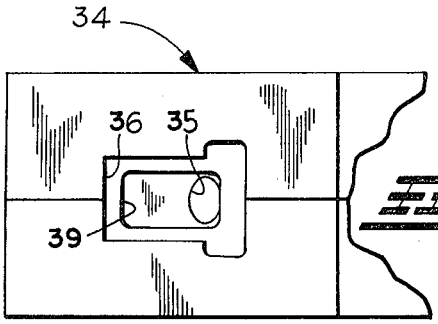
FIg. 11 is a plan view of the bottom face of such mold taken substantially from the line 11—11 of FIG. 10 with the bar removed.

To cast molten metal into the hole by the preferred aluminothermic process, the hanger bar is turned on end at an angle with the inserts on the upper edge. A graphite mold, usually two-part and clamp held together, indicated at 34, is then positioned over the end of the bar so that the riser passage 35 is in a vertical position. The bar is inserted in recess 36 in the bottom face 37 of the mold, the profile configuration of which is seen in FIG. 11. The profile configuration of the recess corresponds to that of the bar with the inserts in place. The riser passage 35 extends between crucible chamber 38 and a slag chamber 39, the latter being exposed to the recess 36. A chill block indicated at 40 is secured to the underside of the bar adjacent the inserts to prevent metal leakage at the end of the saw slot.

A thin metal disk is then positioned at the bottom of the crucible as seen at 41, and a charge of aluminothermic powder topped by an igniting or starting material is then placed in the crucible. Approximately 100 grams of a CADWELD A22 weld metal powder may be employed, such being readily available from Erico Products, Inc, of Solon, Ohio. Typical such powder mixes may be:

| | No. 1 | No. 2 | No. 3 | No. 4 |
|---|---|---|---|---|
| Stannic Oxide ($S_nO_2$) | 42.48% | 41.69% | 39.24% | 38.93% |
| Aluminum | 40.22% | 40.66% | 42.04% | 42.32% |
| Cuprous Oxide ($Cu_2O$) | 13.69% | 14.12% | 15.39% | 15.66% |
| Calcium Fluorspar ($CaF_2$) | 3.61% | 3.53% | 3.33% | 3.09% |
| | 100.00 | 100.00 | 100.00 | 100.00 |

When the charge is in place and a cover 42 is placed on the mold, the charge is ignited burning through the disk with the molten metal resulting from the exothermic reaction flowing down the riser passage and into the hole 22 in the hanger bar. Excess metal and slag builds up in the chamber 39 rather than in the riser passage so that no riser will be formed thus requiring a subsequent trim operation. The chamber 39 also permits the molten metal to settle.

The purpose of placing the riser passage at an angle with respect to the hole 22 is to cause the molten metal descending the riser passage to impinge against the aluminum rather than the copper inserts. An alternative arrangement would be to place the bar in a vertical position with an inclined riser passage or tap hole directed toward the side of the hole opposite the inserts. Since the copper inserts are tinned, some weldment to the inserts is obtained, and also a soldering action. The cast metal also welds to the aluminum of the bar.

When the molten metal is solidified, the mold is removed.

As an alternative, molten zinc may be cast directly into the hole 22, but the end of the bar and the inserts should be preheated.

Figure 6:
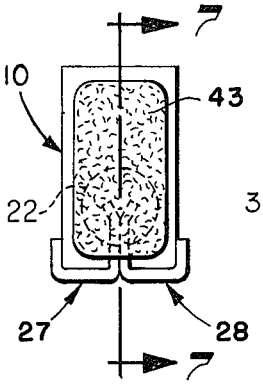
FIG. 6 is an end elevation of the bar similar to FIG. 3, but showing the contact end completed.

In FIG. 6, there is illustrated an end view of the finished contact on the end of the hanger bar with the irregular projection of metal indicated at 43 being formed by the slag chamber 39.

Figure 7:
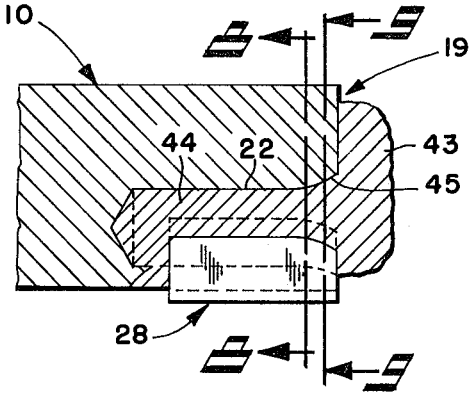
FIG. 7 is a fragmentary vertical section through the completed contact end of the hanger bar taken substantially on the line 7—7 of FIG. 6.
Figure 8:
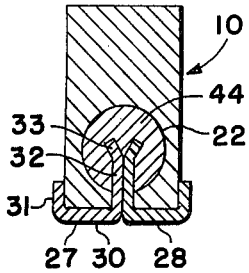
FIG. 8 is a vertical section through the bar taken on the line 8—8 of FIG. 7.
Figure 9:
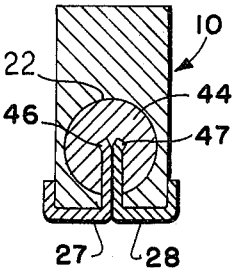
FIG. 9 is a similar vertical section taken on the line 9—9 of FIG. 7 illustrating how the cast metal slightly enlarges the hole and erodes partially the inserts in such hole.

As seen in FIG. 7, the weld metal 44 has filled the hole 22. The flow of the molten metal slightly enlarges the aluminum hole as seen at 45, and in comparing the hole size in FIGS. 8 and 9. Also, near the open end of the hole 22, as seen in FIG. 9, the upper bent edges of the stems 32 of the inserts 27 and 28 may be slightly erroded as shown at 46 and 47, respectively.

When the contact becomes worn or corroded, a new contact may be constructed on the end of the hanger bar quite simply. The projection 43 is simply cut off to provide a flat end face for the bar, and the hole 22 is redrilled. The old inserts are removed and new inserts are replaced in the bottom slot 23 and secured in place in the same manner.

The present invention is applicable to substantially any size or configuration of aluminum bar. However, to show the relative sizes and configuration of the inserts, slot and hole, with a bar which is 2.54 cm. wide by 5.08 cm. high, the hole 22 may have a diameter of 1.59 cm. and be 5.08 cm. deep (+ 0.64 cm., − 0.000 cm.). The slot 23, centered with respect to the bar and the hole 22 may be 0.48 cm. wide (+ 0.04 cm., − 0.000). With reference to the insert, for such bar end dimensions, the flange 31 may be 0.635 cm. high measured from the interior sharp corner 48 seen in FIG. 5. The interior of the bottom 30 may be 1.03 cm. wide. The stem 32, measured from the interior sharp corner 49, may be 1.11 cm. high, while the top bent edge may extend at 30° from the vertical 4.32 cm. The thickness of the insert is approximately 0.24 cm.

Figure 12:
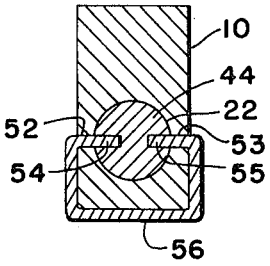
FIGS. 12 through 16 are vertical sections through the bar similar to FIG. 8 illustrating various alternative embodiments of the type of contact which may be employed when the hanger is supported on a notched conductor bar as in FIG. 2.

Referring now to the embodiment of FIG. 12, it will be seen that the bar 10 with the hole 22 drilled in the end thereof, is provided with two laterally extending opposed horizontal slots 52 and 53 which accommodate the inturned flanges 54 and 55 of U-shaped insert 56. The slots 52 and 53 may be formed, for example, by a band saw and cast metal 44 fills the hole.

Figure 10:
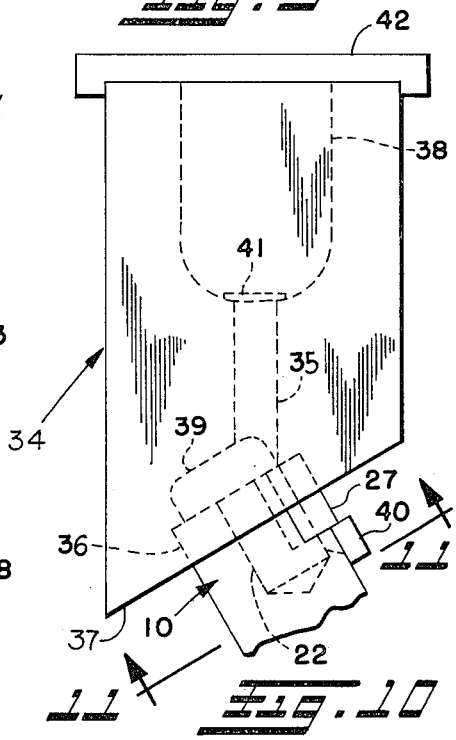
FIG. 10 is a side elevation of a graphite mold, and the bar, broken away, positioned with respect thereto, which mold may be used in casting the metal in the hole by an aluminothermic process.

Such cast metal may be provided by the preferred aluminothermic process illustrated in FIGS. 10 and 11. The insert 56 thus embraces the sides and bottom of the hanger 10 and has two edges projecting into the hole to be secured by the cast weld metal as in the FIG. 8 embodiment.

Figure 13:
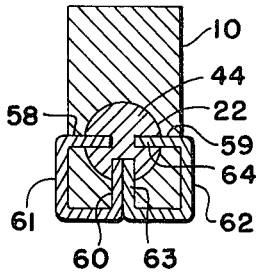

In FIG. 13, the hanger is provided with two horizontally opposed slots 58 and 59 of the same configuration as the slots 52 and 53 in FIG. 12. The hanger is also provided with a bottom central slot 60 of approximately twice the width as the slots 58 and 59. Two inserts 61 and 62 are positioned in such slots, each insert including an upturned bottom flange 63 and a horizontally inturned top flange 64. Both project into the hole 22 as indicated. The upturned flanges 63 of each insert are back-to-back in the wider slot 60. Again, cast metal 44 fills the hole 22 securing the inserts to the bar.

Figure 14:
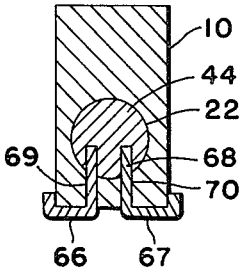

In the embodiment of FIG. 14, J-shape inserts 66 and 67 are provided with the stems 68 thereof in vertical laterally spaced slots 69 and 70. Such stems project well into the hole 22 and cast metal, as aforesaid, is employed to secure the stems and thus the inserts to the bar. As in the FIG. 8 embodiment, the inserts surround the bottom corners of the bar.

Figure 15:
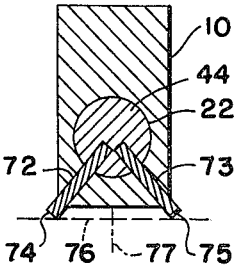

In FIG. 15, two diagonal slots 72 and 73 are cut in the bar 10, such slots extending from the lower corners of the bar into the hole 22. In such slots are positioned inserts 74 and 75 which project from the bar at the lower corners thereof. Cast metal 44 then fills the hole securing the inserts in the position shown. During the formation of the contact shown in FIG. 15, a special jig illustrated by the dotted line 76 may be employed to maintain the symmetry of spacing of the projecting edges of the inserts 74 and 75 equal about the vertical axis 77 of the bar.

Figure 16:
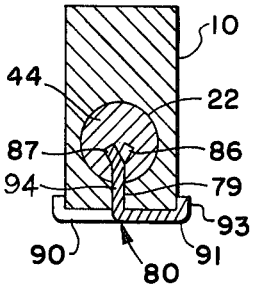

In FIG. 16, a single relatively narrow vertical slot 79 is provided in the bar 10 between the bottom of the bar and the hole 22. The insert 80 seen in more detail in FIG. 17 is inserted in the slot and cast metal 44 fills the hole 22.

Figure 17:
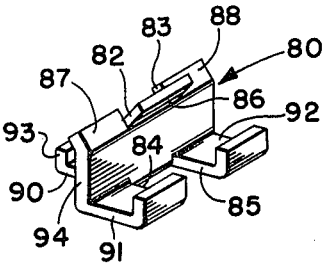
FIG. 17 is a isometric view of the copper insert employed with the FIG. 16 embodiment.

As seen in FIG. 17, the insert 80 is formed from a single sheet of copper, the top edge of which is cut as indicated at 82 and 83 while the bottom edge is cut at 84 and 85. After forming the slits as noted, the top edge of the insert is bent to approximately the same degree and extent as the bent upper edge 13 of the insert 27 seen in FIG. 5. However, the portion of the upper edge between the slits 82 and 83 is bent in the opposite direction but to approximately the same angular extent. The upper edge is thus provided with a center bent portion 86 and two oppositely bent portions 87 and 88 on either side thereof.

Similarly, the bottom edge of the strip is bent horizontally in one direction between the slits 84 and 85 as indicated at 90 and in the opposite horizontal direction as indicated at 91 and 92. The ends of the horizontal tabs thus formed are bent upwardly as indicated at 93 to embrace the bottom corners of the hanger bar. The insert is then inserted into the slot 79 longitudinally with the vertical stem 94 fitting in such slot. It will be appreciated that other forms of a suitable copper contact can be fabricated from a single sheet of copper.

In each of the embodiments shown in FIGS. 12 through 16, the cast metal will be caused to impinge upon the upper edge of the hole 22 away from the edges of the inserts projecting into the hole in the same amount as in FIG. 10.

While the embodiments previously described are designed for use with notched conductor bars as seen in FIG. 2, other electrolytic systems are employed wherein the cathode is electrically connected to anodes of an adjacent tank. In such system, the anodes are provided with wedge shape contacts which engage the contact of the cathode of the adjacent tank and support and locate that end of the cathode hanger. The opposite end of the hanger is supported on a wooded or other insulator rail. In prior art devices, a relatively large frusto-conical copper contact has been threadedly connected to the underside of the end of the cathode. Such fabricated copper contacts are relatively massive requiring a large amount of copper, require extensive machining, turning or threading, and being a simple mechanical connection, do not provide the desired electrical conductivity due to corrosion of the copper to aluminum mechanical connection.

Figure 19:
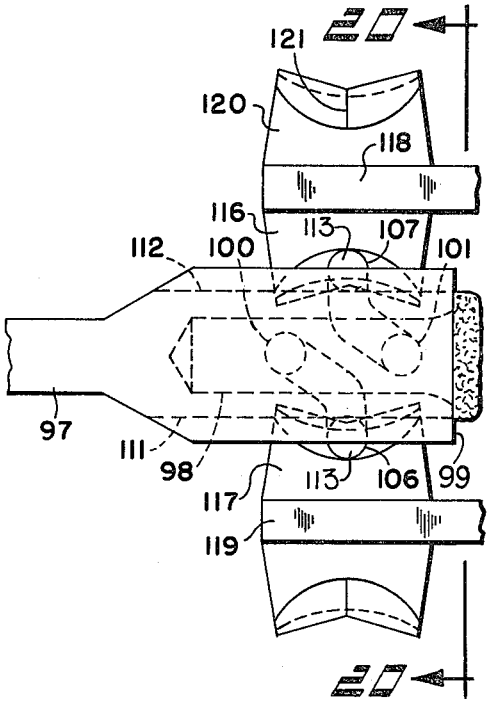
FIG. 19 is a top plan view of the contact construction of FIG. 18 illustrating the hanger supported electrically between two opposed wedge shaped inserts of adjacent anodes.
Figure 18:
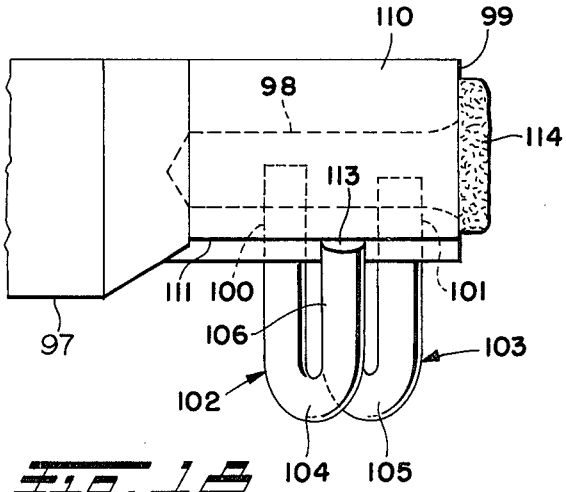
FIG. 18 is a fragmentary side elevation of a contact construction utilizing two specially formed copper rods.
Figure 20:
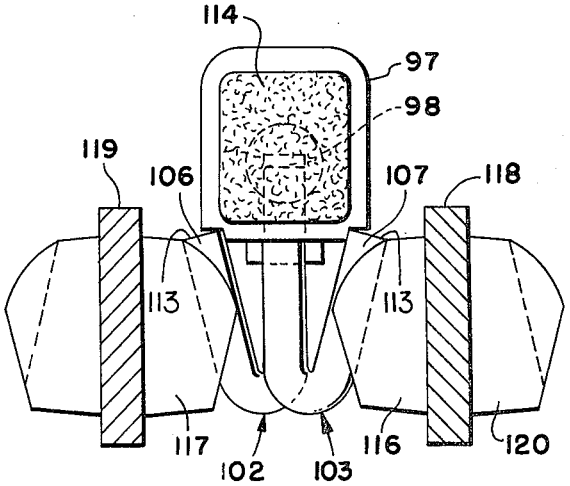
FIG. 20 is a vertical section taken substantia'ly on the line 20—20 of FIG. 19 illustrating the contact construction of FIGS. 18 and 19 in end elevation.

Referring now to FIGs. 18, 19 and 20, it will be seen that the aluminum cathode hanger bar 97, which may be in the form of an elongted casting, has a hole 98 drilled in the end face 99 thereof. The bottom of the hanger adjacent the end is provided with two longitudinally aligned but spaced circular passages indicated at 100 and 101 which extend into the drilled hole 98. Positioned in such passages are bent copper rod inserts 102 and 103. Such rod inserts are each provided with an intermediate compound bend indicated at 104 and 105, respectively, so that axes of the shorter projecting linear ends of such rods indicated at 106 and 107, respectively, from the bend to the outer ends thereof are in the same plane normal to the longitudinal axis of the hanger and at the desired symmetrical angle with respect ot the vertical longitudinal plane of the hanger as seen in FIG. 20. Such compound may be obtained by first bending the copper rod upon itself and then bending the shorter leg laterally of the longer leg.

It is noted that the two inserts need not be of equal length, the insert 103 which is closer to the opening of the hole 98 being somewhat shorter to permit flow of metal therepast properly to fill the hole 98. The projecting end 110 of the cathode hanger may be provided with shoulders indicated at 111 and 112 so that the outer ends 113 seat thereagainst. This then automatically properly positions the other end of the rod insert within the hole 98. With the hole 98 drilled, the holes or passages 100 and 101 extending from the bottom of the hanger into the hole 98, and the inserts properly formed and in place, the hanger is positioned on an incline as in FIG. 10 and cast metal fills the hole 98 by the preferred aluminothermic process leaving the somewhat irregular projection of metal indicated at 114. In this manner, the inserts 102 and 103 are secured in place.

In operation, the cathode hanger is supported on wedge shape projections 116 and 117 secured to and projecting from adjacent anode bars 118 and 119 which extend across the next tank to be supported on a wooden rail or insulator. As seen in FIG. 19, the caathode hanger adjacent to the illustrated hanger will be supported by the wedge shape insert 120 and a similar insert on the next anode, not shown. Such wedge shape inserts provide an inclined notch indicated at 121 in which the inclined straight portions of the outer ends of the inserts 106 and 107 are seated providing both the desired electrical contact and the support and location of the cathode.

Figure 21:
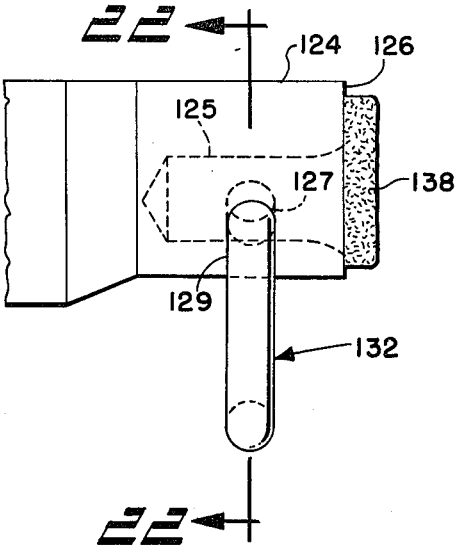
FIG. 21 is a fragmentary side elevation of another form of contact construction similar to the embodiment of FIG. 18 also designed to be supported between adjacent anodes as seen in FIGS. 19 and 20.
Figure 22:
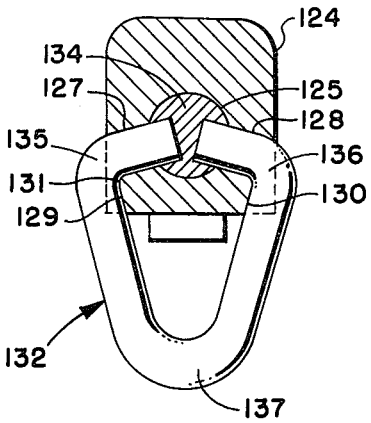
FIG. 22 is a vertical section taken substantially on the line 22—22 of FIG. 21.

In FIGS. 21 and 22, there is another embodiment of the present invention utilizing formed copper rod as the insert. In such embodiment, the hanger 124 has a hole 125 drilled in the end face 126 thereof. Communicating with the hole are two laterally extending circular passages 127 and 128 which are inclined downwardly slightly symmertical with respect to the longitudinal vertical plane through the hanger. Communicating with such circular passages are circular grooves 129 and 130 in the exterior of the hanger, the corner between such groove and the adjoining passage being radiused as indicated at 131. A copper rod insert 132 in the form of a bail is secured to the hanger by cast metal 134 in the hole 125.

The insert is formed by bending the ends of the rod as indicated at 135 and 136 at substantially right angles to the major extent thereof and also bending the center of the rod more sharply as seen at 137. The center bend may be formed in two stages with the final stage inserting the bent ends through the circular passages 127 and 128 with the rod butting against the circular grooves 129 and 130. The same aluminothermic process as depicted in FIG. 10 may be employed to fill the hole with cast metal securing the insert to the hanger. Such process leaves the irregular projection of metal on the end face of the hanger as indicated at 138. The insert is formed such that the exterior of the rod forms the acute angle which is symmetrical to the vertical longitudinal plane of the hanger properly to seat within opposed shape inserts 116 and 117 on adjacent anodes as seen in FIG. 19. Such insert thus supports, locates, and provides the desired improved electrical contact.

Figure 23:
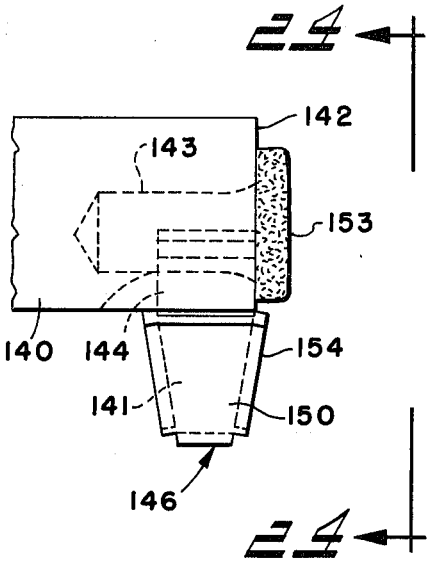
FIG. 23 is a fragmentary side elevation of another embodiment also designed to be supported between adjacent anodes as in FIGS. 19 and 20.
Figure 24:
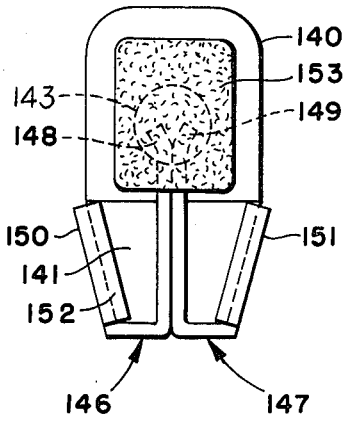
FIG. 24 is an end elevation of the embodiment of FIG. 23 taken substantially from the line 24—24 thereof.

Referring now to FIGS. 23 and 24, there is illustrated an embodiment of the invention wherein the hanger 140 is provided with an integrally formed depending projection 141 in the form of a frustom of a pyramid. Cathode hangers of the type illustrated in FIGS. 18, 21 and 23 are normally cast and the frustom of a pyramid 41 projecting downwardly from the end of the hanger 140 may be cast integrally therewith.

The finished end face 142 of the hanger is provided with drilled hole 143 and a slot 144 is cut through the pyramidal projection into the hole 143 from the bottom of the hanger. Because of the projection 141, a saw having a somewhat larger radius than that employed in connection with FIG. 4 will be required. Copper inserts 146 and 147 having their upper edges 148 and 149 bent slightly outwardly are inserted in the slot in the back-to-back fashion shown. The lower portions of the inserts extend horizontally and are provided with fan shape projections 150 and 151 which extend upwardly in the inclined fashion shown embracing the lateral sides of the projection 141. After the inserts are in place, the edges of the projections are folded or bent around the corners of the pyramid projection as shown at 152 so that all four corners of such projection are embraced by the copper inserts. As in all of the other embodiments, the inserts may be tin coated.

Cast metal by the preferred aluminothermic process of FIG. 10 is then employed to fill the hole 143 leaving the irregular projection of metal 153 on the end face 142. The contact of the embodiment of FIG. 23, after the inserts are in place, forms by the four contact edges 154 a pyramid circumscribed by a conical surface essentially the same as the prior art conical inserts described above and designed to fit the wedge shape inserts seen in FIG. 19.

It will be appreciated, however, that the contacts of the embodiments of FIGS. 18, 21 and 23 employ a lot less copper and provide a better and longer lasting electrical connection between the aluminum bar and the associated conductor.

One of the principal advantages of the present invention is the fact that the contact of the present invention is less susceptible to corrosion. Electrolytes are generally very corrosive. With the present invention, the exact point of welded or sweated connection is relatively protected from the electrolyte usually present in the environment of the present invention. Points of weld being bi-metallic are usually more than normally susceptible to such corrosion.

It can now be seen that there is provided an improved, inexpensive contact for an aluminum electrode hanger bar. Not only does such contact provide better conductivity, but it is less costly to install, it lasts longer, and is even easier to replace. Such contact construction may be utilized in essentially any electrolytic process as a hanger bar for an anode, cathode, or an electrode starting sheet in an electrowinning process.

I, therefore, particularly point out and distinctly claim as my invention:

1. An electrode which includes an aluminum bar, said bar including a hole in the end of the bar, a passage means extending between the hole and the exterior of the bar, a copper insert projecting beneath the bar and extending through the passage means and into the hole, and cast metal filling such hole securing the insert to the bar.

2. An electrode as set forth in claim 1 wherein such hole is drilled in the end face of the bar longitudinally thereof, and said passage means is in the form of a slot which also extends longitudinally.

3. An electrode as set forth in claim 2 wherein said passage means comprises horizontal slots in each side of the bar, and said insert comprises a copper sheet formed to fit around the bottom of the bar with the ends projecting through such slots into the hole.

4. An electrode as set forth in claim 2 wherein said passage means comprises horizontal slots in each side of the bar and a somewhat wider slot in the bottom of the bar, and said insert comprises two copper sheets, each formed to fit around a bottom corner of the bar with one end projecting through one of the horizontal slots and the other through the bottom slot into the hole.

5. An electrode as set forth in claim 2 wherein said passage means comprises two slots in the bottom of the bar, and said insert comprises two copper sheets, each extending from a bottom corner of the bar through a respective slot into the hole.

6. An electrode as set forth in claim 5 wherein said slots are vertical and parallel, said inserts each extending along the bottom of said bar and around a bottom corner.

7. An electrode as set forth in claim 5 wherein one of said slots extends from each corner of the bar directly to the hole, and wherein the outer edge of said inserts project from said slots at the corners of the bar.

8. An electrode as set forth in claim 2 wherein said passage means comprises a single vertical slot centered in the bottom of the hanger, and said insert comprises a copper sheet silt at the bottom to provide a portion extending from the slot along the bottom of the hanger and bent around one bottom corner of the hanger and an offset portion extending from the slot along the bottom of the hanger and bent around the other bottom corner of the hanger.

9. An electrode as set forth in claim 8 wherein said insert is slit at the top and is bent in opposite directions within the hole.

10. An electrode as set forth in claim 1 wherein said insert is tin coated.

11. An electrode as set forth in claim 1 wherein said insert includes a bottom portion projecting beyond the bottom corner of such bar.

12. An electrode as set forth in claim 11 wherein said insert includes an elongated vertically extending portion extending from said bottonm portion through said passage means and into the hole with the top edge of said vertically extending portion being bent within such hole.

13. An electrode as set forth in claim 12 wherein said insert comprises two J-shape inserts with the stems thereof projecting through said passage means and into such hole.

14. An electrode as set forth in claim 13 wherein the tops of the respective stems of the J-shape inserts are bent away from each other in such hole.

15. An electrode as set forth in claim 14 wherein the bottoms of the inserts are bent around the bottom corners of the bar.

16. An electrode as set forth in claim 13 wherein said bar includes a truncated pyramid projecting from the unerside thereof, with said passage means extending therethrough and each insert includes a fan-shape portion covering the lateral sides of said pyramid with flanges bent around the corners thereof.

17. An electrode as set forth in claim 1 wherein such hole is drilled in the end face of the bar longitudinally thereof, and such passage means is in the form of a circular passage extending normal to the axis of the drilled hole.

18. An electrode as set forth in claim 10 wherein said insert is in the form of a bent rod which includes a portion lying in a plane normal to the longitudinal axis of the hanger bar.

19. An electrode as set forth in claim 18 including two circular passages in the sides of the bar, said insert being a single rod formed into a V with the top ends thereof being inturned and projecting through such passages and into the drilled hole.

20. An electrode as set forth in claim 19 wherein said circular passages are in the same vertical plane and are inclined downwardly symmetrically from the drilled hole to the exterior of the bar.

21. An electrode as set forth in claim 18 including two spaced circular passages extending through the bottom of the bar, and a bent rod insert in each, the outer ends of each rod being straight and lying symmetrically in said plane to support and locate the bar with respect to conductor means.

22. An electrode as set forth in claim 21 wherein said circular passages are equally spaced on opposite sides of said plane and extend vertically.

23. An electrode as set forth in claim 22 wherein the outer ends of each insert engage stop shoulders on the bar.

* * * * *